US008550592B2

(12) United States Patent
Usuda et al.

(10) Patent No.: US 8,550,592 B2
(45) Date of Patent: Oct. 8, 2013

(54) FLUID EJECTING APPARATUS HAVING AN INK ABSORBER

(75) Inventors: Hidenori Usuda, Matsumoto (JP); Shinichi Kamoshida, Shiojiri (JP); Kaoru Koike, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 289 days.

(21) Appl. No.: 12/696,443

(22) Filed: Jan. 29, 2010

(65) Prior Publication Data

US 2010/0194820 A1 Aug. 5, 2010

(30) Foreign Application Priority Data

Feb. 3, 2009 (JP) ..... 2009-023061

(51) Int. Cl.
*B41J 2/165* (2006.01)

(52) U.S. Cl.
USPC ..... 347/35

(58) Field of Classification Search
CPC ..... B41J 2002/1742
USPC ..... 347/35
See application file for complete search history.

(56) References Cited

U.S. PATENT DOCUMENTS

| | | | | |
|---|---|---|---|---|
| 4,558,326 | A * | 12/1985 | Kimura et al. | 347/35 |
| 5,966,145 | A * | 10/1999 | Miura et al. | 347/33 |
| 2004/0228669 | A1* | 11/2004 | Nakashima et al. | 400/635 |
| 2005/0212835 | A1* | 9/2005 | Konno | 347/6 |
| 2006/0066706 | A1* | 3/2006 | Nakashima | 347/104 |
| 2007/0146456 | A1* | 6/2007 | Tanabe | 347/101 |
| 2008/0117253 | A1* | 5/2008 | Yearout et al. | 347/36 |
| 2009/0207205 | A1* | 8/2009 | Koike et al. | 347/31 |
| 2012/0062652 | A1* | 3/2012 | Kamiyama | 347/47 |

FOREIGN PATENT DOCUMENTS

| | | | |
|---|---|---|---|
| JP | 59115863 | A * | 7/1984 |
| JP | 2001270097 | A * | 10/2001 |
| JP | 2001-347690 | | 12/2001 |
| JP | 2005-103761 | | 4/2005 |

OTHER PUBLICATIONS

Machine generated English translation of Japanese Patent document 2001-270097A to Watanabe et al. "Ink Jet Printer"; generated via http://www19.ipdl.inpit.go.jp/PA1/cgi-bin/PA1INDEX on Apr. 4, 2012; 6pp.*

Machine generated English translation of specification of JP2001-347690A to Sugaya et al. "Ink Jet Recorder," generated via http://www19.ipdl.inpit.go.jp/PA1/cgi-bin/PA1INDEX on Jan. 25, 2013; 6 pp.*

* cited by examiner

*Primary Examiner* — Shelby Fidler
(74) *Attorney, Agent, or Firm* — Workman Nydegger

(57) ABSTRACT

A fluid ejecting apparatus includes: a rotating body which rotates while holding a medium at its circumferential surface; a fluid ejecting section which ejects fluid toward the medium such that a margin is not formed at an end portion of the medium on the circumferential surface in an axial direction of the rotating body; an absorber which absorbs fluid which has come out of the end portion of the medium on the circumferential surface in the axial direction, out of fluid ejected from the fluid ejecting section, at a position further outside than the end portion; and a rotating body driving mechanism for rotating the rotating body, which drives the rotating body such that driving force by the rotating body driving mechanism is not transmitted to the absorber.

7 Claims, 12 Drawing Sheets

FLUID EJECTING APPARATUS HAVING AN INK ABSORBER

The entire disclosure of Japanese Patent Application No. 2009-023061, filed Feb. 3, 2009, is expressly incorporated herein by reference.

BACKGROUND

1. Technical Field

The present invention relates to a fluid ejecting apparatus and a fluid ejecting method.

2. Related Art

There is already known a fluid ejecting apparatus which has a rotating body which rotates while holding a medium at its circumferential surface, and a fluid ejecting section which ejects fluid onto the medium on the circumferential surface. As one example of such a fluid ejecting apparatus, an ink jet printer (hereinafter referred to as a printer) which prints an image by ejecting ink onto a medium can be exemplified. Also, the case of performing a process (so-called no-margin printing) which prints an image up to end portions of the medium on the circumferential surface in an axial direction of the rotating body by using the printer having the above-described configuration is considered (refer to, for example, JP-A-2005-103761).

In the no-margin printing, the fluid ejecting section ejects fluid toward the medium such that margins are not formed at the end portions of the medium on the circumferential surface in the axial direction. At this time, there is a case where a portion of fluid ejected toward the end portions by the fluid ejecting section gets out of the end portions (refer to FIG. 7). For the purpose of preventing the interior of the printer from being polluted by fluid which has come out of the end portions of the medium in this way, there is a case where an absorber which absorbs fluid which has come out of the end portion of the medium on the circumferential surface in the axial direction at a position further outside than the end portion is provided.

However, if the above-described configuration of the printer is a configuration in which the absorber can affect the rotation of the rotating body, as in a case where the absorber absorbs fluid, so that weight balance of the rotating body is changed, there is a fear that the rotation state of the rotating body will be changed in accordance with the absorption of fluid by the absorber. If the rotation state of the rotating body is changed, there is a fear that it will adversely affect an image which is printed on the medium.

SUMMARY

An advantage of some aspects of the invention is that it allows fluid which has come out of an end portion of a medium held on a rotating body to be absorbed into an absorber without affecting the rotation of the rotating body in the case of performing no-margin printing.

According to a first aspect of the invention, there is provided a fluid ejecting apparatus including: (A) a rotating body which rotates while holding a medium at its circumferential surface; (B) a fluid ejecting section which ejects fluid toward the medium such that a margin is not formed at an end portion of the medium on the circumferential surface in an axial direction of the rotating body; (C) an absorber which absorbs fluid which has come out of the end portion of the medium on the circumferential surface in the axial direction, out of fluid ejected from the fluid ejecting section, at a position further outside than the end portion; and (D) a rotating body driving mechanism for rotating the rotating body, which drives the rotating body such that driving force by the rotating body driving mechanism is not transmitted to the absorber.

Other aspects of the invention will become apparent from the description of this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
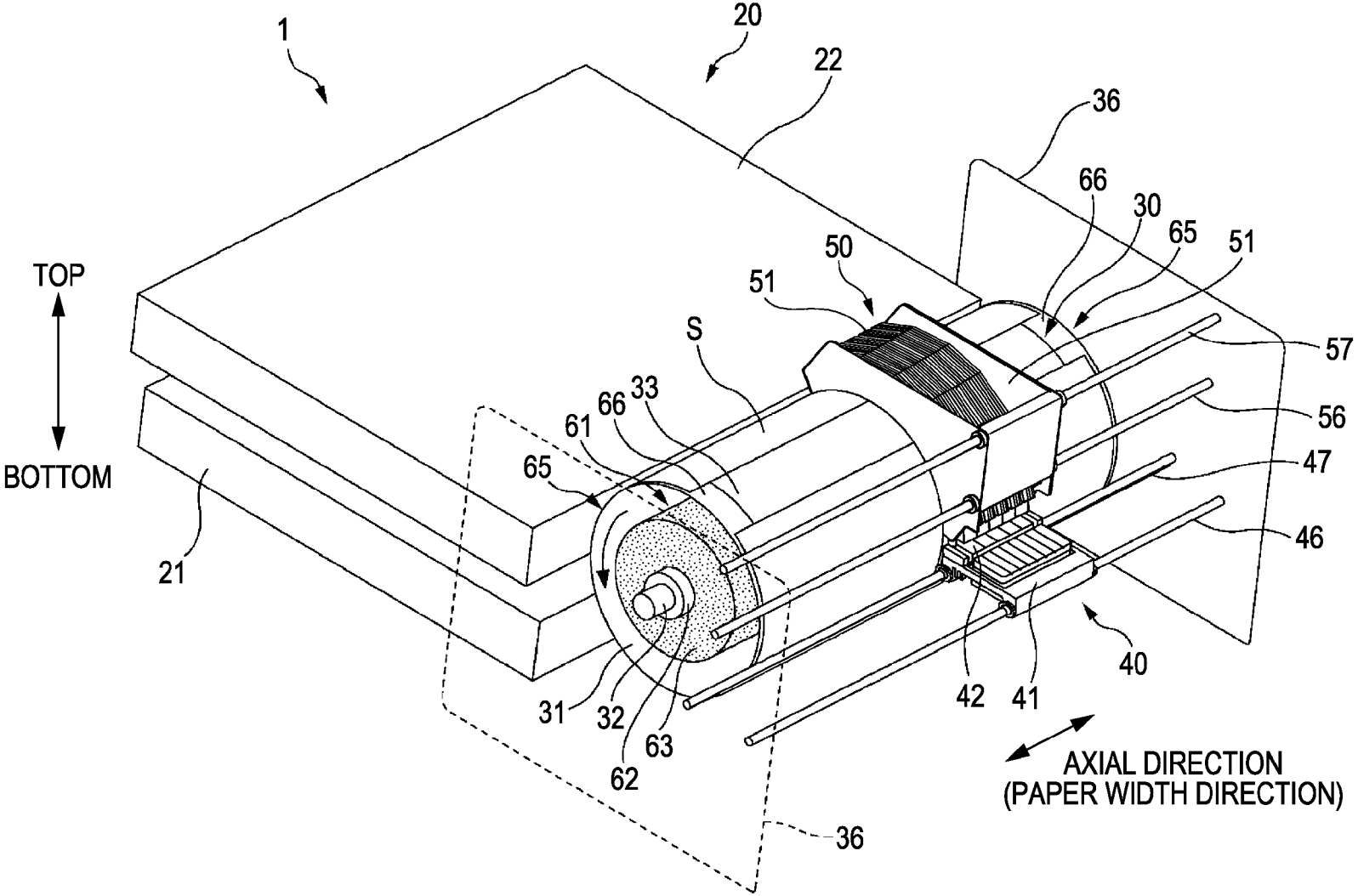
FIG. 1 is a view showing the configuration of the principal section of a printer.

At least the following aspects will become apparent from the description of this specification and the accompanying drawings.

First, a fluid ejecting apparatus according to the invention includes: (A) a rotating body which rotates while holding a medium at its circumferential surface; (B) a fluid ejecting section which ejects fluid toward the medium such that a margin is not formed at an end portion of the medium on the circumferential surface in an axial direction of the rotating body; (C) an absorber which absorbs fluid which has come out of the end portion of the medium on the circumferential surface in the axial direction, out of fluid ejected from the fluid ejecting section, at a position further outside than the end portion; and (D) a rotating body driving mechanism for rotating the rotating body, which drives the rotating body such that driving force by the rotating body driving mechanism is not transmitted to the absorber. According to such a fluid ejecting apparatus, it becomes possible to make fluid which has come out of the end portion of the medium held on the rotating body be absorbed into the absorber without affecting the rotation of the rotating body in the case of performing no-margin printing.

Also, in the fluid ejecting apparatus, the absorber may be rotatable independently of the rotating body in a state where an axial direction of the absorber is coincident with the axial direction of the rotating body, and the apparatus may further include an absorber driving mechanism for rotating the absorber. According to such a fluid ejecting apparatus, it can be avoided that a region which absorbs fluid is localized in the absorber.

Also, the fluid ejecting apparatus may further include a recovery mechanism which recovers fluid absorbed by the absorber from the absorber. According to such a fluid ejecting apparatus, it is suppressed that fluid continues to be accumulated in the absorber, and therefore, it becomes possible to maintain the absorption performance of the absorber.

Also, in the fluid ejecting apparatus, the absorber may have an outer circumferential portion made of a sponge and absorb fluid which has come out of the end portion at the outer circumferential portion, and the recovery mechanism may be provided with a pressing portion which presses the outer circumferential portion, and squeeze and recover fluid absorbed by the absorber from the outer circumferential portion by allowing the pressing portion to press the outer circumferential portion when the absorber driving mechanism rotates the absorber. According to such a fluid ejecting apparatus, it becomes possible to recover fluid absorbed, by the absorber by a relatively simple mechanism.

Also, in the fluid ejecting apparatus, the absorbers may be provided one on each of both sides of the rotating body in the axial direction, a cover member which has an outer surface adjoining the circumferential surface of the rotating body in the axial direction and surrounds and covers the absorber may be provided for each absorber, each of the cover members may have an opening at the outer surface, the length of the circumferential surface in the axial direction may be shorter than the length of the medium in the axial direction, the rotating body may hold a central portion of the medium in the axial direction at the circumferential surface, the cover member may hold an end portion of the medium in the axial direction at the outer surface, the fluid ejecting section may face the opening when ejecting fluid toward the end portion, and the absorber may absorb fluid which has come out of the end portion, at an exposed portion exposed by the opening, out of the absorber. According to such a fluid ejecting apparatus, it becomes possible to adequately perform the no-margin printing with respect to the medium of a size which exceeds the width of the circumferential surface of the rotating body, and also allow fluid which has come out of the end portions of the medium to be adequately absorbed into the absorber.

Also, in the fluid ejecting apparatus, the rotating body may be of a hollow shape and have in its circumferential surface a pair of openings located along the rotation direction of the rotating body, the absorber may be disposed in the interior of the rotating body, the length of the circumferential surface in the axial direction may be longer than the length of the medium in the axial direction, the rotating body may hold the medium at the circumferential surface in a state where one end portion of the medium in the axial direction is located on one opening and the other end portion is located on the other opening, the fluid ejecting section may face the openings when ejecting fluid toward the one end portion and the other end portion, and the absorber may absorb fluid which has come out of the one end portion and the above-mentioned other end portion, at exposed portions exposed by the openings, out of the absorber. According to such a fluid ejecting apparatus, it becomes possible to adequately perform the no-margin printing on the medium of a size which is smaller than the width of the circumferential surface of the rotating body, and also allow fluid which has come out of the end portions of the medium to be adequately absorbed into the absorber.

In addition, according to a second aspect of the invention, there is a fluid ejecting method including: holding a medium on a circumferential surface of a rotating body which rotates; ejecting fluid toward the medium such that a margin is not formed at an end portion of the medium on the circumferential surface in an axial direction of the rotating body; allowing fluid which has come out of the end portion of the medium on the circumferential surface in the axial direction, out of the ejected fluid, to be absorbed into an absorber at a position further outside than the end portion; and driving the rotating body by a rotating body driving mechanism such that driving force by the rotating body driving mechanism is not transmitted to the absorber. According to such a fluid ejecting method, it becomes possible to make fluid which has come out of the end portion of the medium held on the rotating body be absorbed into the absorber without affecting the rotation of the rotating body in the case of performing the no-margin printing.

Concerning a Fluid Ejecting Apparatus According to the Invention

Hereinafter, an ink jet printer (hereinafter referred to as a printer 1) which is one example of a fluid ejecting apparatus according to the invention will be explained.

First, the outline of the printer 1 is explained with reference to FIG. 1. FIG. 1 is a diagram showing the configuration of the principal section of the printer 1. In addition, in FIG. 1, a paper S of a single sheet shape which is one example of a medium is shown, and also in the following explanation, the printer 1 which prints an image with the paper S as a medium is explained.

In the printer 1, a rotary drum 31 as one example of a rotating body is rotated in a state where the paper S is held on a circumferential surface 33 of the rotary drum 31, and, meanwhile, ink which is ejected from a head 42 as one example of a fluid ejecting section lands on the paper S on the circumferential surface 33. In this way, an image is formed on the paper S. In addition, the ink is one example of fluid and in this embodiment, is ultraviolet cure type ink (hereinafter referred to as UV ink) which receives ultraviolet rays, thereby being cured. However, with respect to the ink, ink other than ultraviolet cure type ink (that is, common aqueous ink or oily ink) is also acceptable.

Also, the printer 1 can perform a printing process (so-called no-margin printing) which prints an image without providing margins at end portions in the paper width direction of the paper S on the circumferential surface 33. That is, the head 42 ejects ink toward the paper S on the circumferential surface 33 such that margins are not formed at end portions in the paper width direction of the paper S. Here, the paper width direction is the short side direction of the paper S and is coincident with the axial direction of the rotary drum 31 in a state where the paper S is held on the circumferential surface 33 of the rotary drum 31 (in other words, the paper S is held on the circumferential surface 33 of the rotary drum 31 such that the paper width direction and the axial direction of the rotary drum 31 are coincident with each other).

Configuration of the Printer 1

Figure 2:
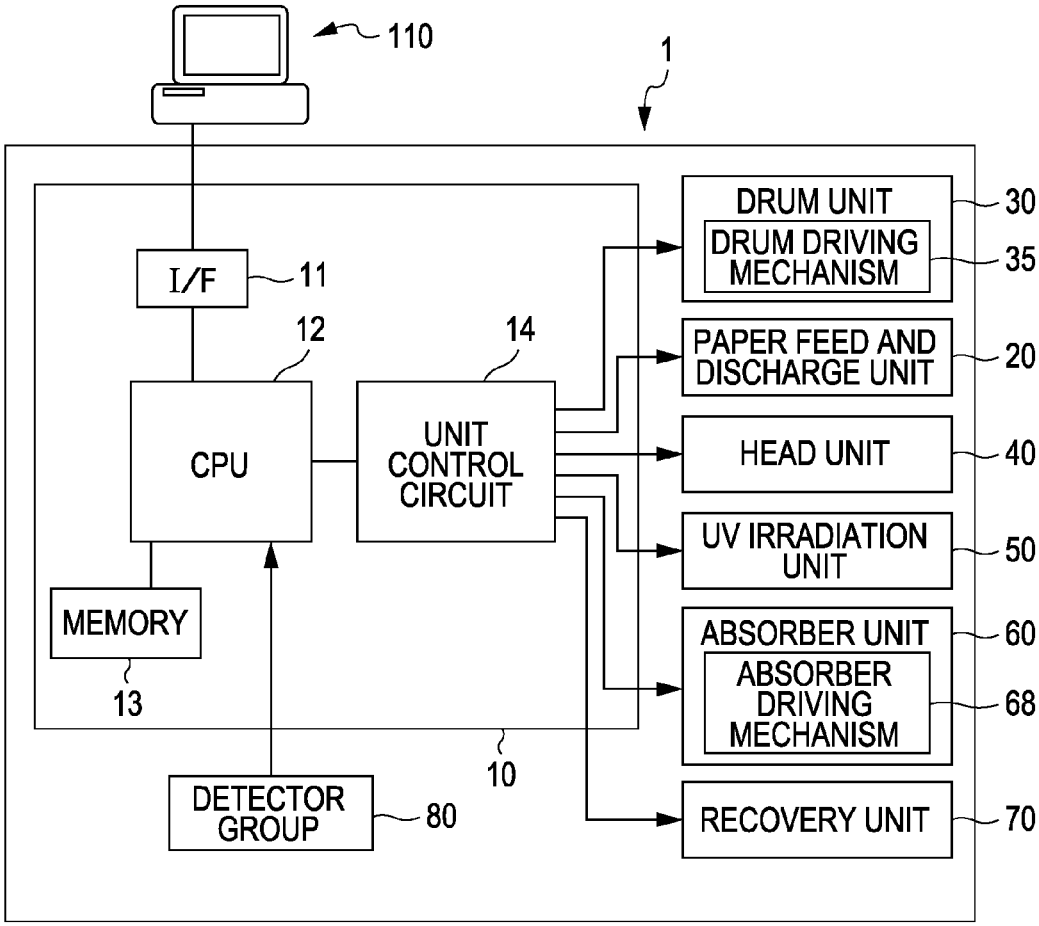
FIG. 2 is a block diagram showing the entire configuration of the printer.
Figure 3:
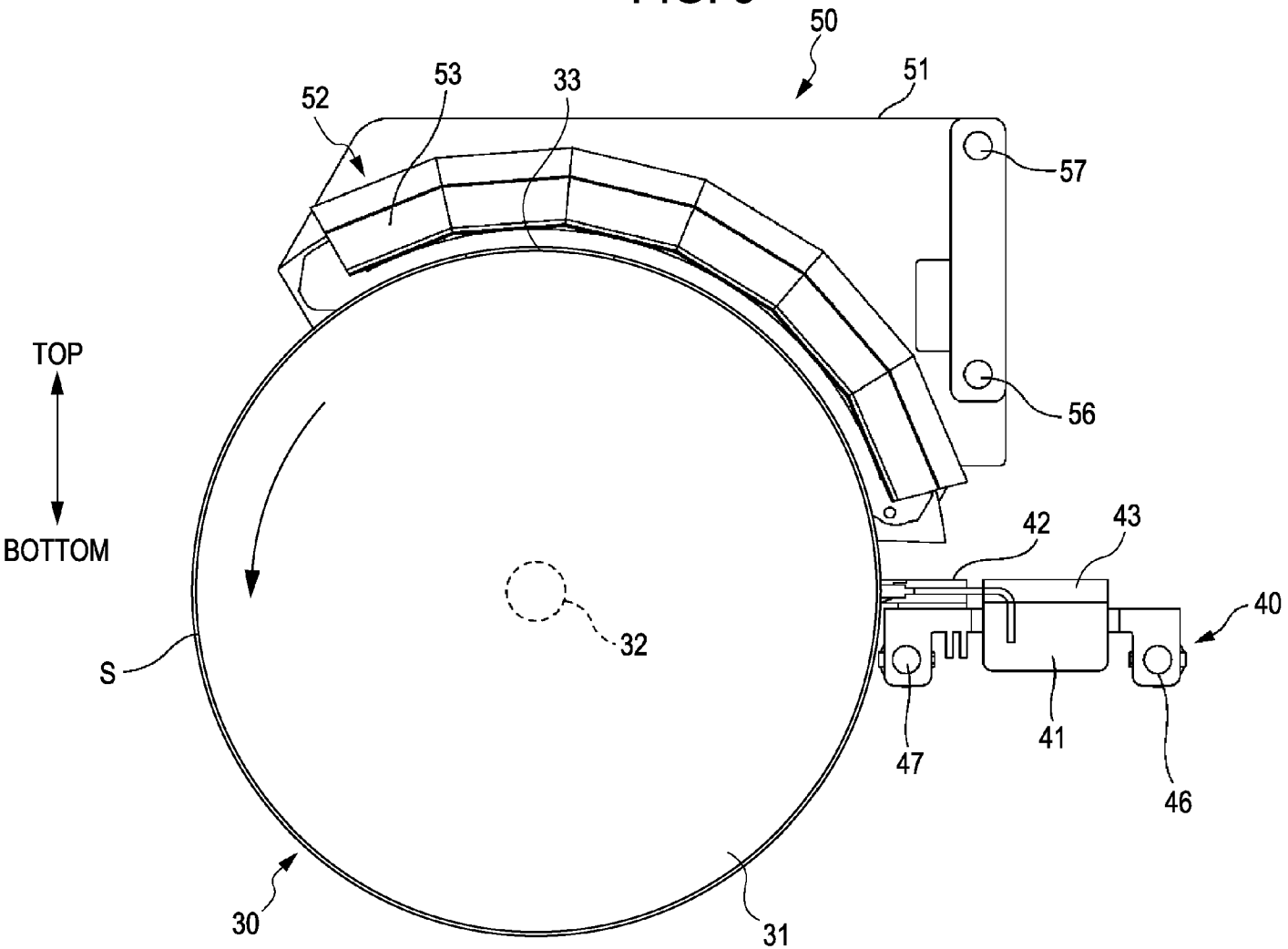
FIG. 3 is a view showing cross-sectional structures of a drum unit, a head unit, and a UV irradiation unit.
Figure 4A:
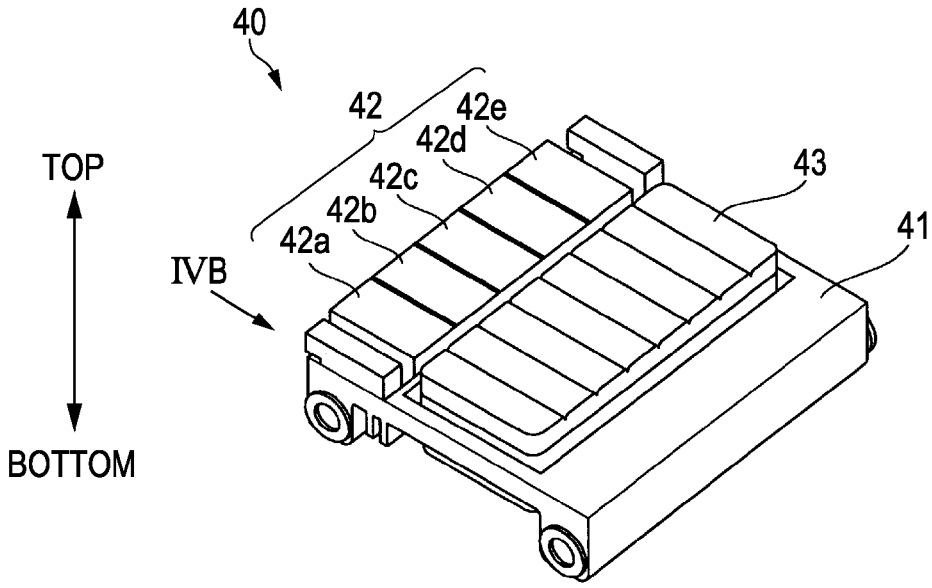
FIG. 4A is a perspective view showing the head unit.
Figure 4B:
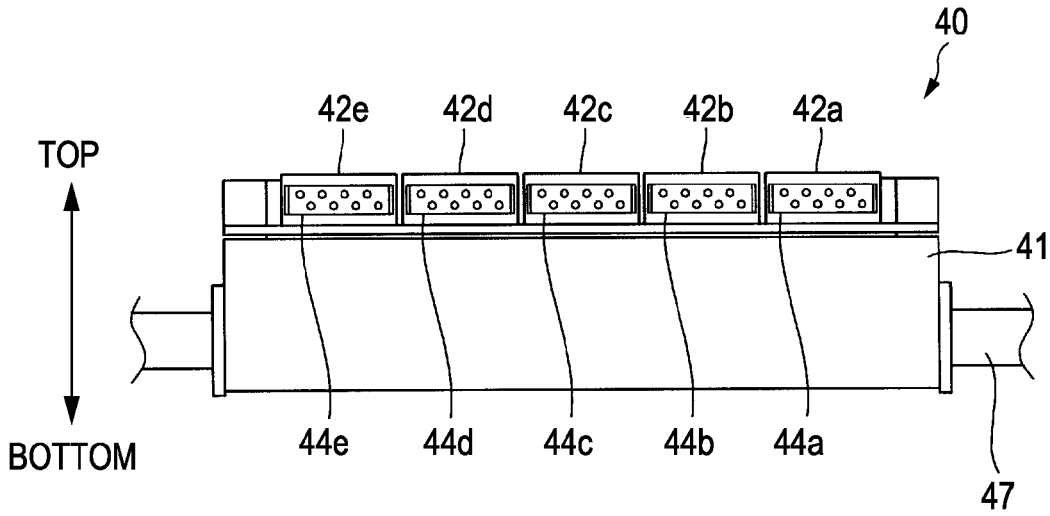
FIG. 4B is a view showing a head observed from a direction indicated by an arrow IVB of FIG. 4A.
Figure 5A:
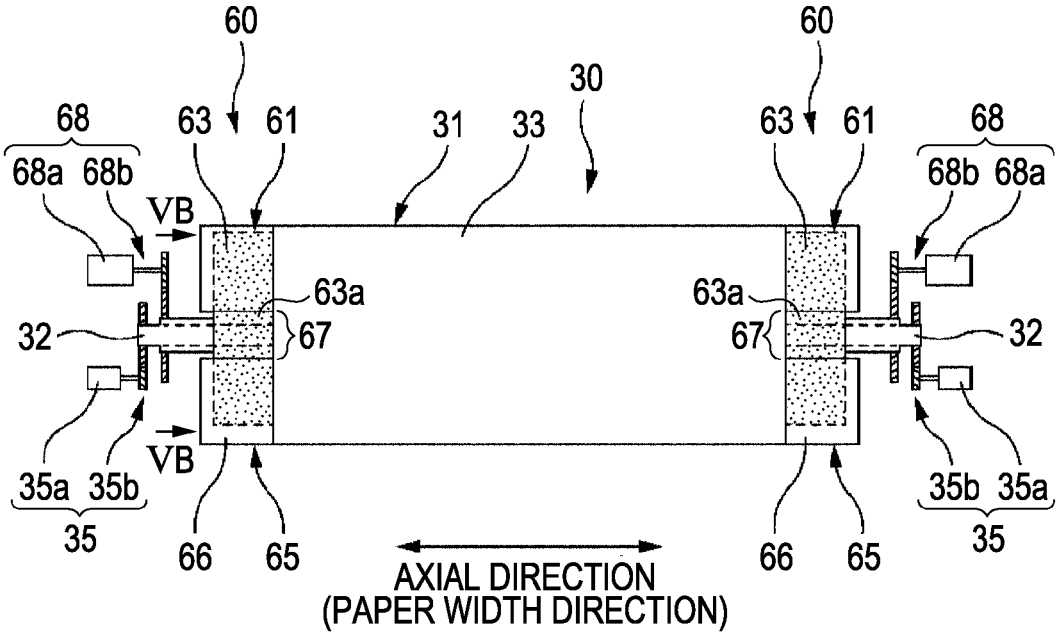
FIG. 5A is a view showing the drum unit and an absorber unit observed from the head.
Figure 5B:
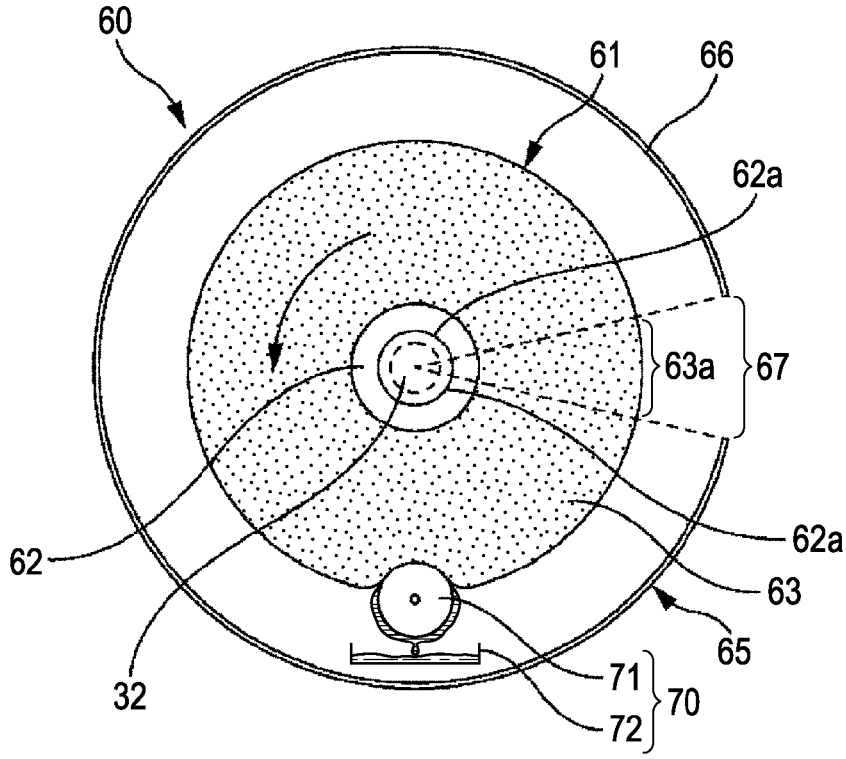
FIG. 5B is a view showing the absorber unit and a recovery unit observed from a direction indicated by an arrow VB of FIG. 5A.

Next, the configuration of the printer 1 is explained with reference to FIGS. 2 to 5B. FIG. 2 is a block diagram showing the entire configuration of the printer 1. FIG. 3 is a view showing the cross-sectional structures of a drum unit 30, a head unit 40, and a UV irradiation unit 50. FIG. 4A is a perspective view showing the head unit 40, and FIG. 4B is a view showing the head 42 observed from a direction indicated by an arrow IVB of FIG. 4A. FIG. 5A is a view showing the drum unit 30 and an absorber unit 60 observed from the head 42, and FIG. 5B is a view showing the absorber unit 60 and a recovery unit 70 observed from a direction indicated by an arrow VB of FIG. 5A.

The printer 1 has a controller 10, a paper feed and discharge unit 20, the drum unit 30, the head unit 40, the UV irradiation unit 50, the absorber unit 60, and the recovery unit 70, as shown in FIG. 2.

The controller 10 is a control device built in the printer 1, receives printing data which is sent from a host computer 110 through an interface 11, and controls each of the above-mentioned units 20, 30, 40, 50, 60, and 70 through a unit control circuit 14 by a CPU 12 in accordance with a program stored in a memory 13. As a result, an image corresponding to the printing data is printed on the paper S. In addition, the conditions of the interior of the printer 1 are monitored by a detector group 80, and on the basis of the detection results, the controller 10 controls each of the units 20, 30, 40, 50, 60, and 70.

The paper feed and discharge unit 20 is to perform the feeding and the discharging of the paper S and has a paper feed tray 21 and a paper discharge tray 22 (refer to FIG. 1). The papers S in the paper feed tray 21 are fed one by one to the drum unit 30. The paper S with an image formed thereon is fed into the paper discharge tray 22. In addition, the paper feed and discharge unit 20 of this embodiment feeds (discharges) the paper S which is longer in paper width than the width (length in the axial direction) of the circumferential surface 33 of the rotary drum 31. In other words, in this embodiment, the width of the circumferential surface 33 is shorter than the width of the paper S.

The drum unit 30 has the rotary drum 31 described above and a drum driving mechanism 35 as a rotating body driving mechanism which rotates the rotary drum 31, as shown in FIG. 2. The rotary drum 31 is of a hollow shape, and a rotary shaft 32 thereof is supported to be rotatable on a pair of frames 36 (refer to FIG. 1). The drum driving mechanism 35 is to rotate the rotary drum 31 and is provided with a drum motor 35*a* and a transmission mechanism 35*b* such as a gear wheel train (refer to FIG. 5A). Then, if the driving force by the drum driving mechanism 35 (specifically, the rotation of the drum motor 35*a*) is transmitted to the rotary shaft 32 of the rotary drum 31 through the transmission mechanism 35*b*, the rotary drum 31 rotates integrally with the rotary shaft 32 in a rotation direction indicated by an arrow in FIG. 3.

The head unit 40 has a head carriage 41, as shown in FIG. 3. The head carriage 41 is supported on a pair of guide shafts 46 and 47 and reciprocates along the axial direction of the rotary drum 31. On the head carriage 41, the head 42 is mounted. In this embodiment, five heads 42*a* to 42*e* (refer to FIG. 4B) which eject UV ink of different colors are provided. The heads 42*a* to 42*e* respectively have nozzle faces 44*a* to 44*e* which are each formed with a plurality of nozzles, and eject ink from each nozzle. Also, each of the heads 42*a* to 42*e* (specifically, each of the nozzle faces 44*a* to 44*e*) is disposed to face the paper S on the circumferential surface 33 of the rotary drum 31 by the movement of the head carriage 41. Meanwhile, each of the heads 42*a* to 42*e* ejects UV ink from the nozzle toward the paper S.

In addition, in this embodiment, as described above, it is possible to print an image up to the end portions in the paper width direction of the paper S by the no-margin printing. That is, each of the heads 42*a* to 42*e* ejects UV ink toward the paper S such that UV ink lands over a range from one end in the paper width direction of the paper S to the other end.

The UV irradiation unit 50 has an irradiation section carriage 51, as shown in FIG. 3. The irradiation section carriage 51 is supported on a pair of guide shafts 56 and 57 and reciprocates along the axial direction of the rotary drum 31. On the irradiation section carriage 51, an irradiation section 52 is mounted. The irradiation section 52 has a plurality of lamps 53 which are located on the downstream side further than the head 42 in the rotation direction of the rotary drum 31 and aligned along the rotation direction. Then, the irradiation section 52 irradiates the paper S with ultraviolet rays (UV), which are emitted from the lamps 53. In this way, the UV ink landed on the paper S is cured, thereby being fixed to the paper S.

The absorber unit 60 is to absorb excess ink (refer to FIG. 7) which is generated at the time of the no-margin printing. The excess ink is UV ink out of the end portion in the paper width direction of the paper S on the circumferential surface 33 of the rotary drum 31, out of UV ink ejected from the head 42. In addition, the generation of the excess ink will be described later in the section of an example of the operation of the printer 1.

The absorber unit 60 has an absorber 61 and a cover member 65 of approximately an annular shape which surrounds and covers the absorber 61, as shown in FIG. 5A.

The absorber 61 is a main portion of the absorber unit 60 and absorbs the above-mentioned excess ink at a position further outside than the end portion of the paper S on the circumferential surface 33 in the axial direction of the rotary drum 31. In this embodiment, the absorbers 61 are provided one at each of both sides of the rotary drum 31 in the axial direction. As shown in FIG. 5B, each absorber 61 is a roller-like member, is provided with an outer circumferential portion 63 made of a sponge, and absorbs the excess ink at the outer circumferential portion 63. In addition, the absorber 61 may also be detachably mounted on a printer main body (in the printer 1, a portion other than the absorber 61). According to such a configuration, in a case where the absorber 61 has been deteriorated, it can be replaced with new absorber 61.

The cover member 65 is provided for each absorber 61 and is disposed in a state where the rotary drum 31 is interposed between the cover members 65, as shown in FIG. 5A. Each cover member 65 is arranged in a concentric pattern with respect to the rotary drum 31 and has approximately the same outer diameter as that of the rotary drum 31. That is, each cover member 65 has an outer surface 66 which adjoins the circumferential surface 33 of the rotary drum 31 in the axial direction of the rotary drum 31. Further, each cover member 65 is fixed so as not to rotate along with the rotary drum 31. Therefore, during the execution of the printing process, while the rotary drum 31 rotates, each cover member 65 remains in a stationary state.

Also, as shown in FIG. 5B, each of the cover members 65 has in its outer surface 66 an opening 67 formed by cutting away a portion in the circumferential direction of the outer surface 66. The opening 67 is located along the axial direction of the rotary drum 31 and provided at a position facing the head 42 in the circumferential direction of the outer surface 66.

The above-mentioned excess ink reaches the absorber (specifically, the outer circumferential portion 63 of the absorber 61) disposed in the cover member 65 through the opening 67 and is absorbed into the absorber 61. In other words, the absorber 61 absorbs the excess ink at an exposed portion 63*a* (refer to FIG. 5B) exposed by the opening 67, out of the outer circumferential portion 63 of the absorber 61. Incidentally, the exposed portion 63*a* is, out of the outer circumferential portion 63, a portion which is defined by two virtual planes (shown by broken lines in FIG. 5B) extending from the center of the absorber 61 to the ends of the opening 67 in the circumferential direction, and located between both virtual planes.

In addition, the absorber unit 60 of this embodiment is provided with an absorber driving mechanism 68 for separately rotating the absorber 61 at the time of the rotation of the rotary drum 31 (refer to FIG. 2). That is, in this embodiment, each absorber 61 can be rotated independently of the rotary drum 31, so that it is possible to rotate the rotary drum 31 and the absorber 61 without interfering with each other.

Specifically, each absorber 61 is separated from the rotary drum 31 and supported to be rotatable in a state where the axial direction thereof corresponds with the axial direction of the rotary drum 31 (specifically, in a state where each absorber 61 is arranged in a concentric pattern with respect to the rotary drum 31). In addition, in a rotary shaft 62 of each absorber 61, a shaft insertion hole 62*a* is formed extending along the axial direction thereof, as shown in FIG. 5B, and the rotary shaft 32 of the rotary drum 31 is inserted into the shaft insertion hole 62*a* with some play.

On the other hand, the above-mentioned absorber driving mechanism 68 is provided for every absorber 61. Each absorber driving mechanism 68 is provided with an absorber motor 68*a* and a transmission mechanism 68*b* such as a gear wheel train (refer to FIG. 5A). Then, if the rotation of the absorber motor 68*a* is transmitted to the rotary shaft 62 of the absorber 61 through the transmission mechanism 68*b*, the absorber 61 rotates integrally with the rotary shaft 62 of the absorber 61 in a rotation direction indicated by an arrow in FIG. 5B.

As described above, in this embodiment, with respect to each of the rotary drum 31 and the absorber 61, separate driving mechanisms 35 and 68 are provided, so that it is possible separately to rotate the rotary drum 31 and the absorber 61. That is, the drum driving mechanism 35 rotates the rotary drum 31 such that the driving force by the drum driving mechanism 35 is not transmitted to the absorber 61, and the absorber driving mechanism 68 rotates the corresponding absorber 61 such that the driving force by the absorber driving mechanism 68 is not transmitted to the rotary drum 31.

Then, each absorber 61 is rotated by the driving force by the absorber driving mechanism 68, so that the exposed portion 63*a* of the outer circumferential portion 63 is changed, thereby absorbing the excess ink. In this way, it can be suppressed that, out of the outer circumferential portion 63, a region which absorbs the excess ink is localized. In other words, the region which absorbs the excess ink exists over a wide range in the circumferential direction of the outer circumferential portion 63, so that the absorber 61 can maintain its absorption performance.

The recovery unit 70 is one example of a recovery mechanism and is to recover the excess ink absorbed by the absorber 61 from the absorber 61. The recovery unit 70 is provided for each absorber 61 and has a pressing roller 71 as one example of a pressing portion, and a liquid receiver (refer to FIG. 5B).

The pressing roller 71 is disposed inside the cover member 65 and presses the outer circumferential portion 63 of the absorber 61 by coming into contact with the outer surface of the outer circumferential portion 63 when the absorber driving mechanism 68 rotates the absorber 61. In this way, out of the outer circumferential portion 63, a portion which comes into contact with the pressing roller 71 is elastically deformed so as to be compressed inwardly in a radial direction. As a result, the ink held in the compressed portion is squeezed out of the portion. In addition, the pressing roller 71 of this embodiment is in the state of being always pressing the outer circumferential portion 63 in contact with the outer circumferential portion 63. The liquid receiver 72 is provided below the pressing roller 71 and receives the ink squeezed out of the outer circumferential portion 63 of the absorber 61.

As described above, in the recovery unit 70, when the absorber driving mechanism 68 rotates the absorber 61, the pressing roller 71 presses the outer circumferential portion 63 of the absorber 61, so that the ink (excess ink) absorbed by the absorber 61 is squeezed out of the outer circumferential portion 63, and the ink is received and recovered by the liquid receiver 72. In addition, the ink recovered by the liquid receiver 72 is sent to a given liquid destination by liquid transport equipment (not shown), thereby being subjected to an appropriate treatment at the liquid destination.

Example of the Operation of the Printer 1

Next, a printing operation as an example of the operation of the printer 1 configured as described above is explained. Incidentally, the printing operation corresponds to a fluid ejecting method concerning this embodiment.

If the controller 10 receives printing data from the host computer 110, the controller 10 analyzes the contents of various commands included in the printing data, thereby controlling each of the units 20, 30, 40, 50, and 70. In this way, first, the drum driving mechanism 35 rotates the rotary drum 31, and also the lamps 53 of the irradiation section 52 are turned on. In such a state, the paper S in the paper feed tray 21 is fed toward the rotary drum 31. The paper S fed to the rotary drum 31 is held wound around the circumferential surface 33 and rotates along with the rotary drum 31.

Figure 6:
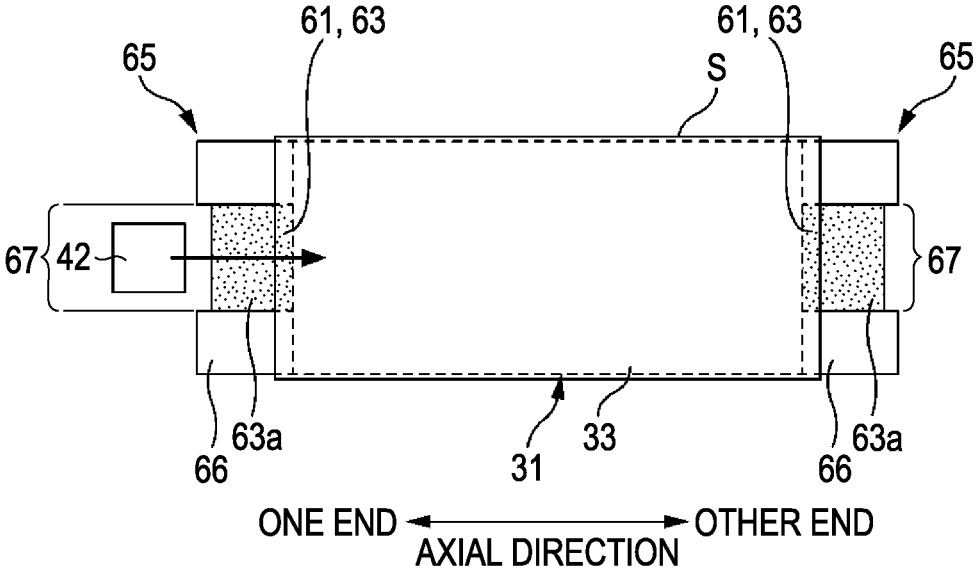
FIG. 6 is a view showing a position where a paper is held.

Also, in this embodiment, as described above, the paper S which is longer in paper width than the width of the circumferential surface 33 of the rotary drum 31 is fed. That is, since the size of the paper S is a size which exceeds the width of the circumferential surface 33 of the rotary drum 31, the rotary drum 31 holds the paper S in conjunction with a pair of cover members 65 disposed so as to interpose the rotary drum 31 therebetween, as shown in FIG. 6. Specifically, as shown in the drawing, the rotary drum 31 holds the central portion in the paper width direction of the paper S at the circumferential surface 33, and each cover member 65 holds the end portion in the paper width direction at the outer surface 66. In such a state, the paper S on the circumferential surface 33 rotates along with the rotary drum 31. FIG. 6 is a view showing a position where the paper S is held.

Further, while the rotary drum 31 rotates, each cover member 65 is stationary, and therefore, when the paper S rotates along with the rotary drum 31, the end portion in the paper width direction of the paper S slides on the outer surface 66 of the cover member 65.

During the rotation of the paper S, each of the heads 42*a* to 42*e* ejects UV ink toward the paper S while facing the paper S. In this way, an image piece (the piece of an image) following the rotation direction of the rotary drum 31 is printed on one end side in the paper width direction of the paper S. Thereafter, in accordance with the rotation of the rotary drum 31, the lamp 53 of the irradiation section 52 is disposed facing a portion of the paper S, on which the image piece is printed. Thus, the UV ink constituting the image piece receives ultraviolet rays, thereby being cured, and thus, the image piece is fixed to the paper S.

After the fixing of the image piece, if the rotary drum 31 rotates one revolution, the head carriage 41 moves by a given distance from one end sides of the guide shafts 46 and 47 to the other end sides along with the heads 42*a* to 42*e* (the irradiation section carriage 51 also moves in the same way by a given distance from one end sides of the guide shafts 56 and 57 to the other end sides). Then, the above-described processes (the ejection process of UV ink by the head 42 and the ultraviolet irradiation process by the irradiation section 52) are performed again. Thereafter, for every rotation of the rotary drum 31, the head carriage 41 moves and the above-described processes are repeated. As a result, image pieces are printed in sequence over a range from one end side in the paper width direction of the paper S to the other end side, and finally, an image as a complete image is formed. Thereafter, the paper S, on which the image is printed, is peeled from the rotary drum 31 and fed into the paper discharge tray 22. In this way, the printing operation is completed.

Figure 7:
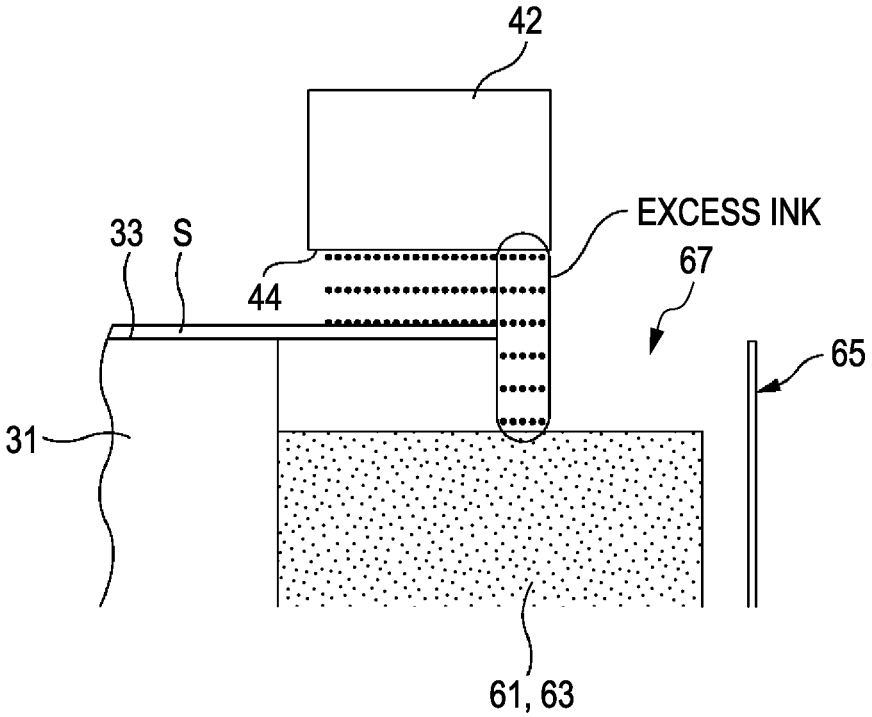
FIG. 7 is a view showing the positional relationship between the paper and the head in no-margin printing.

Incidentally, the printer 1 performs the above-described no-margin printing as the process of printing an image by the above-described printing operation. In the no-margin printing, in order to print an image on the end portion in the paper width direction of the paper S, the head 42 ejects UV ink toward the end portion. At this time, as shown in FIG. 7, the head 42 (specifically, the nozzle face 44) faces the end portion in a state where the head 42 is somewhat poked out further outward than the end portion in the axial direction of the rotary drum 31. Since the head 42 ejects UV ink toward the end portion in such a state, as shown in the drawing, a portion out of the UV ink which is ejected from the head 42 is abandoned without landing on the paper S. The abandoned UV ink is the excess ink. In addition, FIG. 7 is a view showing the positional relationship between the paper S and the head 42 in the no-margin printing. In FIG. 7, for simplification of the illustration, only one head 42 is shown.

In addition, when the head 42 ejects UV ink toward the end portion in the paper width direction of the paper S, the head 42 faces the opening 67 formed in the outer surface 66 of the cover member 65. More specifically, the end portion which is located outside in the axial direction of the rotary drum 31, out of the nozzle face 44 of the head 42, faces the opening 67 (refer to FIG. 7). Therefore, the excess ink enters into the interior of the cover member 65 through the opening 67 without being attached to the outer surface 66 of the cover member 65. Thus, it becomes possible to prevent the outer surface 66 and the paper S held on the outer surface 66 from being polluted.

Then, if the excess ink enters into the interior of the cover member 65, the excess ink is absorbed into the outer circumferential portion 63 of the absorber 61. More specifically, the absorber 61 receives and absorbs the excess ink at the exposed portion 63*a* which is exposed by the opening 67, out of the outer circumferential portion 63 of the absorber 61.

Figure 8A:
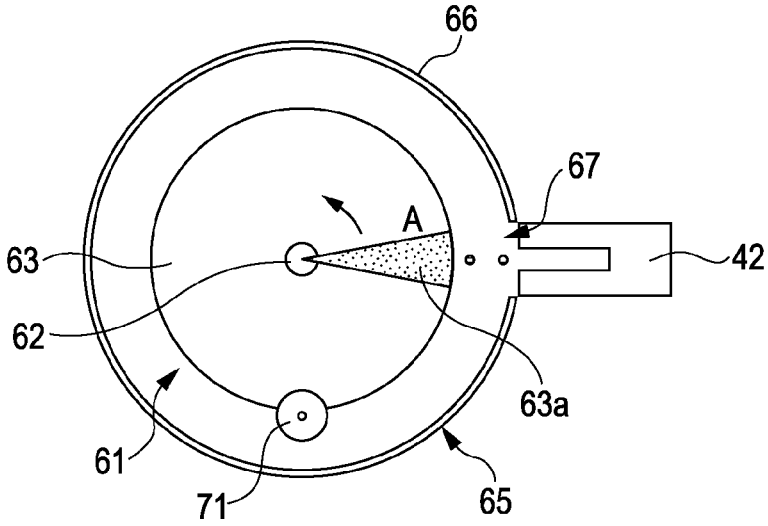
FIGS. 8A to 8C are views showing states in which out of an outer circumferential portion, a region corresponding to an exposed portion is changed in accordance with the rotation of an absorber.
Figure 8B:
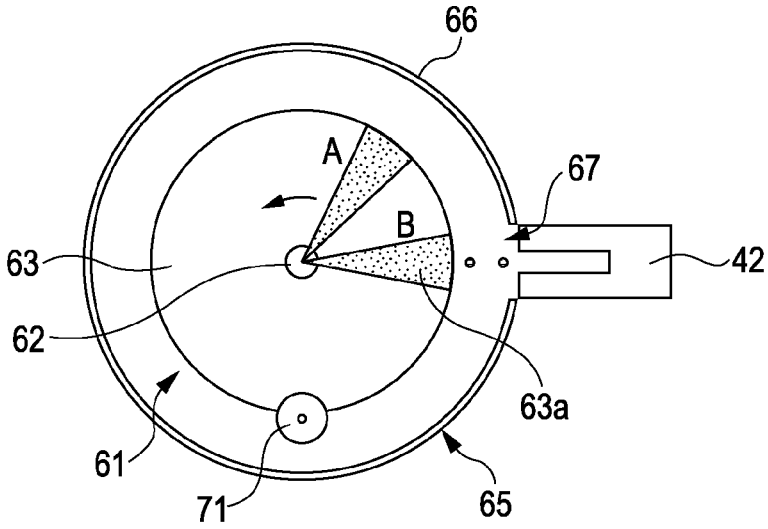
Figure 8C:
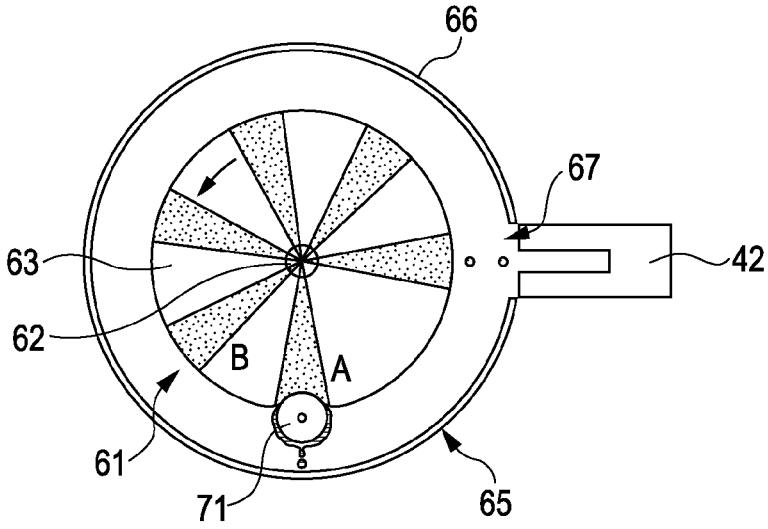

Also, since the absorber driving mechanism 68 rotates the absorber 61, as shown in FIGS. 8A to 8C, the exposed portion 63*a* of the outer circumferential portion 63, that is, the region which receives and absorbs the excess ink is changed in accordance with the rotation of the absorber 61. FIGS. 8A to 8C are views showing states in which, out of the outer circumferential portion 63, a region corresponding to the exposed portion 63*a* is changed in accordance with the rotation of the absorber 61.

Specifically, first, if the no-margin printing is carried out in a state where a region A out of the outer circumferential portion 63 becomes the exposed portion 63*a*, the excess ink is absorbed into the region A (refer to FIG. 8A). Thereafter, as the absorber 61 rotates by a given amount before the subsequent no-margin printing is performed, the exposed portion 63*a* is changed from the region A to a region B. At this time, the absorber 61 keeps the excess ink absorbed by the region A at the region A.

Then, if the subsequent no-margin printing is performed, the excess ink is absorbed into the region B (refer to FIG. 8B). Thereafter, for every time the no-margin printing is performed, the rotation of the absorber (in other words, the changing of a region which becomes the exposed portion 63*a*) and the absorption of the excess ink are repeated, so that in the outer circumferential portion 63, regions keeping the excess ink are formed at constant intervals in the rotation direction of the absorber (FIG. 8C). Also, if the region keeping the excess ink reaches the contact position with the pressing roller 71 in accordance with the rotation of the absorber 61, the ink is squeezed out of the region, so that the ink kept in the region is recovered from the outer circumferential portion 63 of the absorber 61 (refer to FIG. 8C).

As a result, it can be avoided that a region which absorbs the excess ink is localized in the outer circumferential portion 63 of the absorber 61, and also, it can be suppressed that ink continues to be accumulated in each region of the outer circumferential portion 63. In this way, the absorber 61 maintains absorption performance (maintains a continuously utilizable state).

Concerning the Effectiveness of the Printer 1 of this Embodiment

In the printer 1 of this embodiment, by the configuration described above, it is possible to make the excess ink be absorbed into the absorber 61 without affecting the rotation of the rotary drum 31.

To facilitate understanding of the explanation, for example, a case where the rotary drum 31 and the absorber 61 integrally rotate (for example, a case where the absorber 61 is attached to the end portion in the axial direction of the rotary drum 31) is assumed. In such a configuration, if the absorber 61 absorbs the excess ink, the weight balance of the rotary drum 31 is changed, so that there is a danger that the rotation of the rotary drum 31 will be obstructed. Then, if the rotary drum 31 does not adequately rotate, there is also a case where deviation or the like occurs in the landing position of ink, so that the image quality of an image is adversely affected.

On the contrary, in this embodiment, as described above, the drum driving mechanism 35 drives the rotary drum 31 such that driving force by the drum driving mechanism 35 is not transmitted to the absorber 61. In this way, the rotary drum 31 can rotate without being interfered by the absorber 61. In other words, when the no-margin printing is performed, it becomes possible to make the excess ink be absorbed into the absorber 61 without affecting the rotation of the rotary drum 31. Therefore, in a case where an image is printed by the no-margin printing, according to the printer 1 of this embodiment, it becomes possible to obtain an image having a desired image quality.

In addition, in this embodiment, the absorber 61 can rotate independently of the rotary drum 31, and the absorber driving mechanism 68 which rotates the absorber 61 is provided. In this way, as described above, it can be avoided that a region which absorbs the excess ink is localized in the absorber 61 (specifically, the outer circumferential portion 63 of the absorber 61), so that it is possible to maintain absorption performance of the absorber 61. However, a configuration is also acceptable in which, while the rotary drum 31 rotates, the absorber 61 is stationary (does not rotate). In such a case, although the excess ink is intensively absorbed into one place of the absorber 61, it become possible to prevent the ink absorbed into the absorber 61 from being scattered by centrifugal force at the time of the rotation of the absorber 61.

In addition, in this embodiment, since the recovery unit 70 which recovers the ink absorbed by the absorber 61 from the absorber 61 is provided, a problem that occurs due to the fact that ink continues to be accumulated in the absorber 61 (for example, a problem such as the fact that the ink which continues to be accumulated in the outer circumferential portion 63 induces the clogging of the outer circumferential portion 63) is eliminated, so that the absorption performance of the absorber 61 is maintained. In addition, the recovery unit 70 of this embodiment is provided with the pressing roller 71, and when the absorber driving mechanism 68 rotates the absorber 61, the pressing roller 71 presses the outer circumferential portion 63 of the absorber 61, which is made of a sponge, so that the ink absorbed by the absorber 61 is squeezed out of the outer circumferential portion 63 and recovered. In this manner, in this embodiment, it is possible to recover the ink absorbed by the absorber 61 by a relatively simple mechanism.

Figure 9:
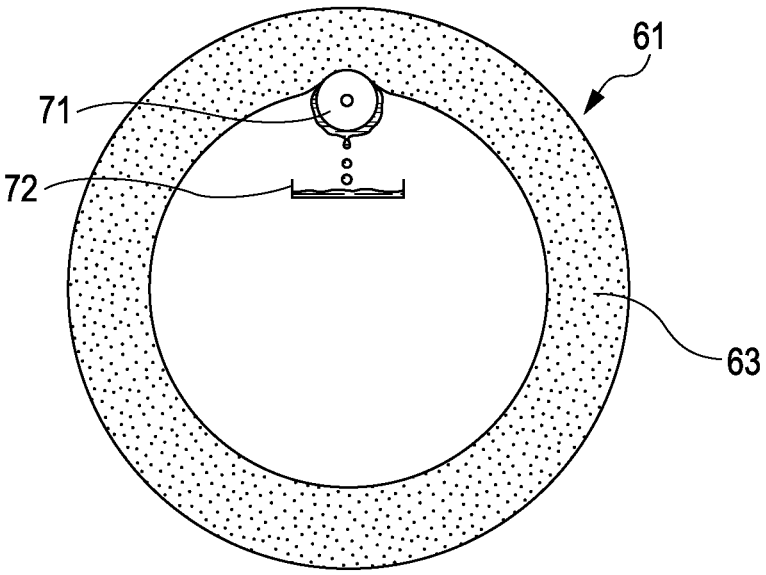
FIG. 9 is a view showing a modified example of a portion which is pressed by a pressing roller in the outer circumferential portion of the absorber.

In addition, although in this embodiment, the pressing roller 71 presses the outer circumferential portion 63 by coming into contact with the outer surface of the outer circumferential portion 63 of the absorber 61, the pressing position is not to be limited to the above-described position, and, for example, as shown in FIG. 9, in a case where the outer circumferential portion 63 of the absorber 61 is formed into an annular shape, a configuration is also acceptable in which the pressing roller 71 presses the outer circumferential portion 63 by coming into contact with the inner surface of the outer circumferential portion 63. However, it is more preferable to bring the pressing roller 71 into direct contact with a surface on the side which receives the excess ink, that is, the outer surface, out of the outer circumferential portion 63, because it is possible to efficiently squeeze ink out of the outer circumferential portion 63. FIG. 9 is a view showing a modified example of a portion which is pressed by the pressing roller 71 in the outer circumferential portion 63 of the absorber 61.

Also, in this embodiment, the cover member 65 which has the outer surface 66 that adjoins the circumferential surface 33 of the rotary drum 31 in the axial direction of the rotary drum 31, and surrounds and covers the absorber 61 is provided. The cover member 65 has in its outer surface 66 the opening 67 located along the axial direction. Also, in this embodiment, the width of the circumferential surface 33 is shorter than the width of the paper S, so that the cover member 65 holds the paper S in cooperation with the rotary drum 31. Then, at the time of the no-margin printing, the head 42 faces the opening 67 when ejecting UV ink toward the end portion in the paper width direction, and the absorber 61 absorbs the excess ink at the exposed portion 63*a* exposed by the opening 67, out of the absorber 61 (specifically, the outer circumferential portion 63 of the absorber 61).

In the configuration described above, it is possible to take the end portion in the paper width direction of the paper S away from the absorber 61, so that it is possible to prevent the end portion in the paper width direction from being polluted by the contact with the absorber 61. However, a configuration is also acceptable in which the cover member 65 is not provided and in place of the cover member 65, the absorber 61 holds the end portion in the paper width direction of the paper S at its outer circumferential surface (that is, the absorber 61 and the end portion in the paper width direction of the paper S come into contact with each other).

Concerning the Printer 1 of a Second Embodiment

In the above-described embodiment (hereinafter referred to as a first embodiment), an aspect in which the width of the circumferential surface 33 of the rotary drum 31 is shorter than the width of the paper S has been explained. In such an aspect, although the paper S of a size which exceeds the width of the circumferential surface 33 is fed, the no-margin printing is adequately carried out, and also the excess ink which is generated at the time of the no-margin printing can be adequately absorbed into the absorber 61. However, an aspect (hereinafter referred to as a second embodiment) in which the width of the circumferential surface 33 of the rotary drum 31 is longer than a paper width can also be considered. The printer 1 of the second embodiment is explained below. Incidentally, in the following explanation, the explanation of portions overlapping with those of the first embodiment is omitted.

Figure 10A:
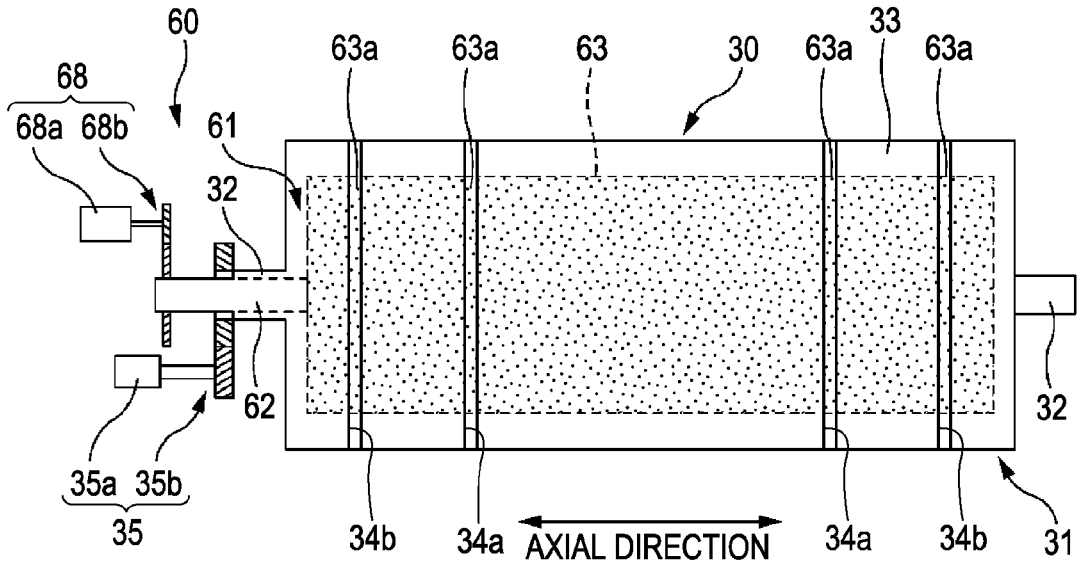
FIG. 10A is a view showing a drum unit and an absorber unit concerning a second embodiment observed from the head.

In the second embodiment, as described above, the width of the circumferential surface 33 of the rotary drum 31 is longer than the width of the paper S. In other words, in this embodiment, the paper S which is shorter in paper width than the width of the circumferential surface 33 of the rotary drum 31 is fed from the paper feed tray 21. In addition, in the second embodiment, a pair of slits 34 located along the rotation direction of the rotary drum 31 are formed in the circumferential surface 33 of the rotary drum 31, as shown in FIG. 10A. FIG. 10A is a view showing a drum unit 30 and an absorber unit 60 concerning the second embodiment observed from the head 42. A pair of slits 34 are one example of a pair of openings and are arranged approximately in parallel at a slightly shorter distance than the width of the paper S, as shown in the drawing. In addition, the length of each slit 34 in the rotation direction is set to be somewhat longer than the length of the paper S in the direction intersecting with the paper width direction.

Figure 10B:
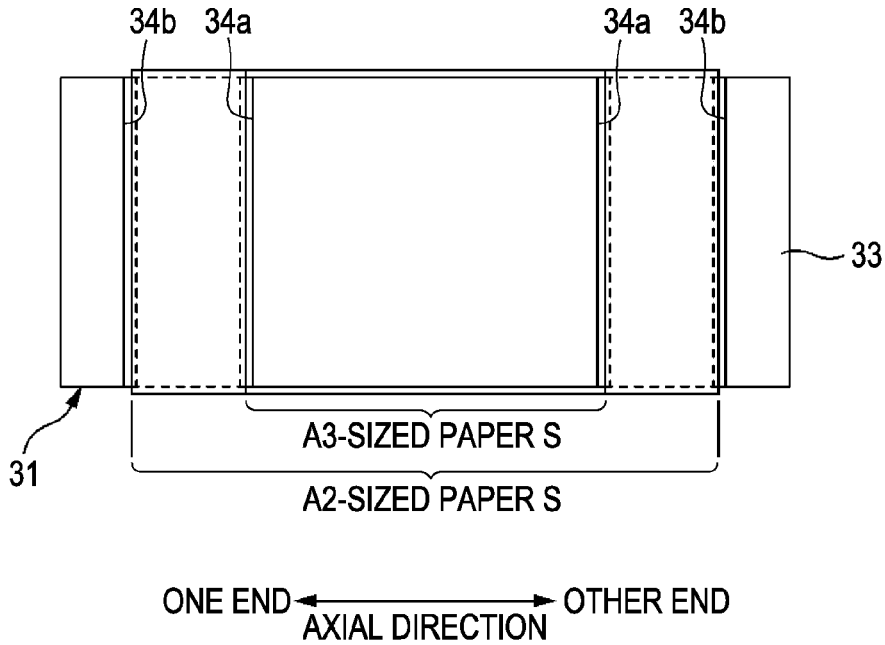
FIG. 10B is a view showing a position where the paper is held in the second embodiment.

Then, the rotary drum 31 holds the paper S at the circumferential surface 33 in a state where one end portion in the paper width direction of the paper S is located on one slit 34 and the other end portion in the paper width direction is located on the other slit 34, as shown in FIG. 10B. FIG. 10B is a view showing a position where the paper S is held in the second embodiment. In addition, a pair of slits 34 may also be provided in plural sets in accordance with the kind of a size of the paper S which is held on the circumferential surface 33 of the rotary drum 31, as shown in FIGS. 10A and 10B. In FIGS. 10A and 10B, as a specific example, the rotary drum 31 is shown in which a pair of slits 34*a* corresponding to an A3-sized paper S and a pair of slits 34*b* corresponding to an A2-sized paper S are provided in the circumferential surface 33.

Figure 11:
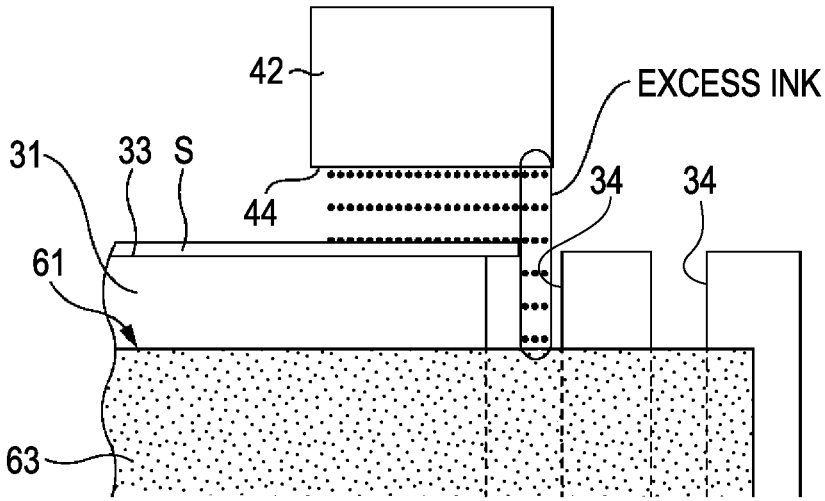
FIG. 11 is a view showing the positional relationship (positional relationship in the second embodiment) between the paper and the head in the no-margin printing.

During the time when the rotary drum 31 rotates while holding the paper S, as described above, the head 42 ejects ink toward the paper S. Also, in a case where the no-margin printing is carried out in the second embodiment, when the head 42 ejects UV ink toward one end portion and the other end portion in the paper width direction of the paper S, the head 42 faces the slit 34. Specifically, as shown in FIG. 11, out of the nozzle face 44 of the head 42, an end portion which is located outside in the axial direction of the rotary drum 31 faces the slit 34. At this time, out of UV ink ejected from the head 42, ink which is abandoned without landing on the paper S enters into the interior of the rotary drum 31 through the slit 34 as excess ink. FIG. 11 is a view showing the positional relationship (positional relationship in the second embodiment) between the paper S and the head 42 in the no-margin printing.

Figure 12:
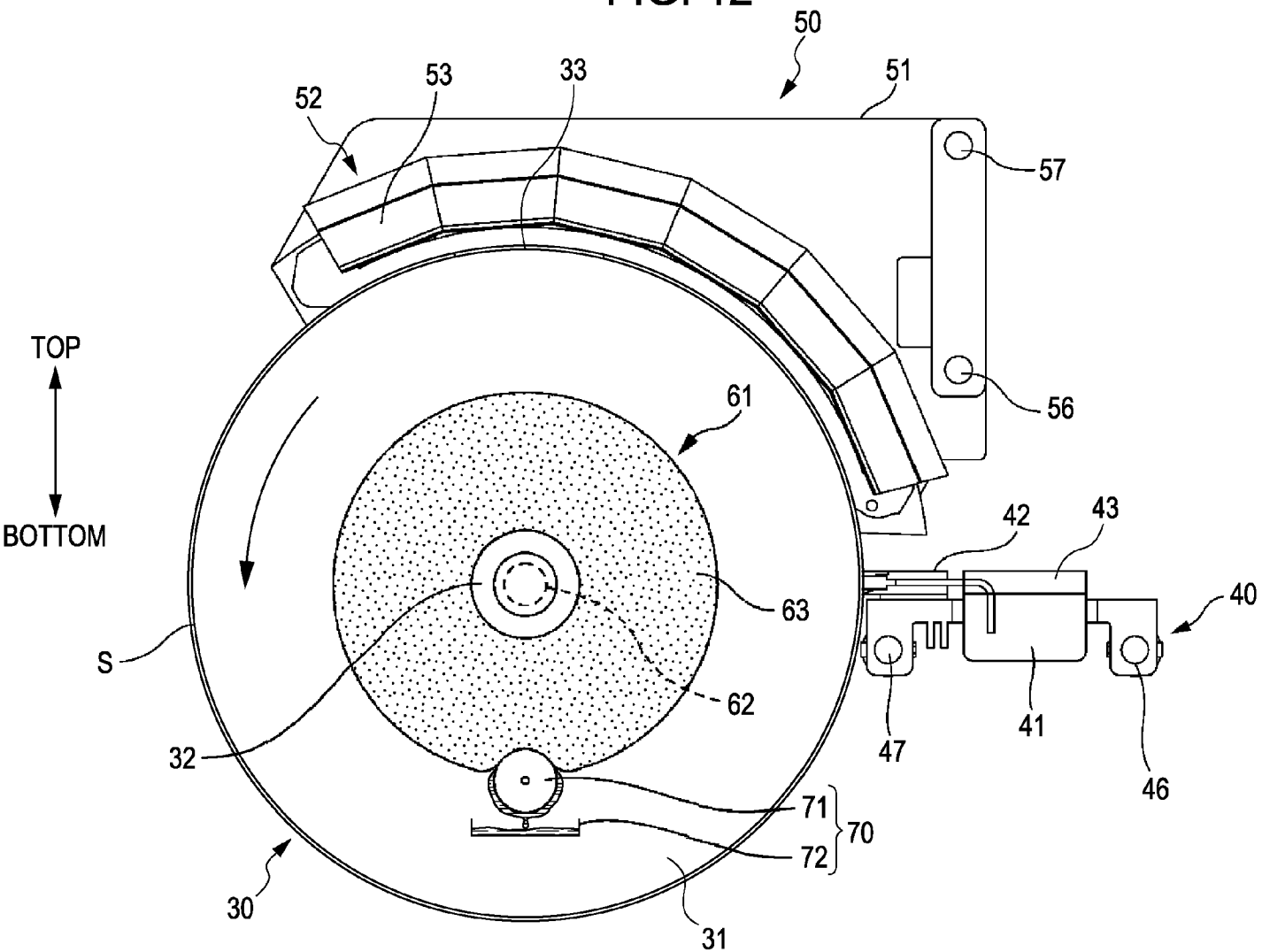
FIG. 12 is a view showing cross-sectional structures of the drum unit, the absorber unit, a recovery unit, etc. of the second embodiment.

On the other hand, in the second embodiment, as shown in FIG. 12, only one absorber 61 is disposed inside the rotary drum 31. Also, the length of the absorber 61 in the axial direction of the rotary drum 31 is set to somewhat longer than the distance between the slits 34. Then, the absorber 61 absorbs the excess ink entered into the rotary drum 31 through the slits 34, at the exposed portions 63*a* which are exposed by the slits 34, out of the absorber 61 (specifically, the outer circumferential portion 63 of the absorber 61).

In addition, also in the second embodiment, similarly to the first embodiment, the absorber 61 can rotate independently of the rotary drum 31 in a state where the axial direction of the absorber 61 is coincident with the axial direction of the rotary drum 31 (specifically, in a state where the rotary drum 31 and the absorber 61 are arranged in a concentric pattern). In addition, also in the second embodiment, separate driving mechanisms 35 and 68 are provided for each of the rotary drum 31 and the absorber 61 (refer to FIG. 10A), and the rotary drum 31 and the absorber 61 respectively rotate without interfering with each other.

According to the configuration as described above, the printer 1 of the second embodiment carries out the printing operation by the same procedure as the above-described procedure. Also, in the second embodiment, with respect to the paper S of a size which is smaller than the width of the circumferential surface 33 of the rotary drum 31, the no-margin printing can be adequately performed, and also it is possible to make the excess ink be adequately absorbed into the absorber 61. Other than that, the second embodiment is the same as the first embodiment, and the same operation and effect as the first embodiment are achieved.

In addition, a printer 1 is also acceptable in which the configuration of the first embodiment and the configuration of the second embodiment are combined, and such a printer 1 can deal with any of a case where the width of the paper S is longer than the width of the circumferential surface 33 of the rotary drum 31 and a case where the paper width is shorter than the width of the circumferential surface 33.

Other Embodiments

Although the printer 1 as one example of the fluid ejecting apparatus according to the invention, and the printing operation by the printer 1 as one example of the fluid ejecting method have been explained above on the basis of the embodiments, the above-described embodiments are for easy understanding of the invention and are not to limit the invention. The invention can be modified or improved without departing from the purpose of the invention, and also it is needless to say that the equivalent thereto is included in the invention.

Figure 13:
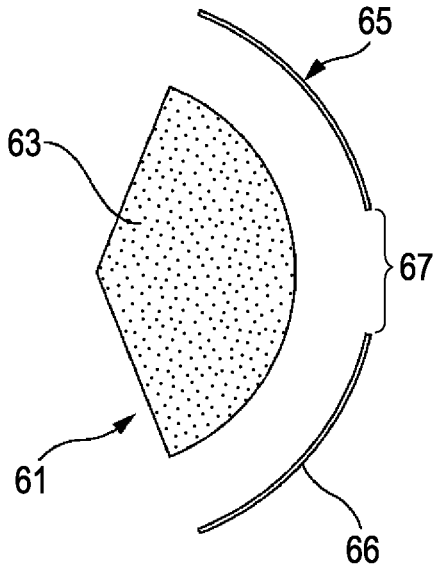
FIG. 13 is a view showing a modified example of the absorber.

Also, in the above-described embodiments, the absorber 61 of a roller type has been explained. However, the absorber is not to be limited to this, but an absorber 61 of a type (for example, a drum type or an annular belt type) other than the roller type is also acceptable. In addition, the shape of the absorber 61 is not to be limited to a shape which is circular in cross-section (specifically, a cross-section with an axial direction as a normal direction), but, for example, a shape having a fan-shaped cross-section as shown in FIG. 13 is also acceptable. FIG. 13 shows a modified example of the absorber 61.

Also, in the above-described embodiments, the printer 1 (so-called serial printer) provided with the head 42 which moves in the axial direction of the rotary drum 31 in accordance with the movement of the head carriage 41 has been explained. However, the invention is not to be limited to this. For example, a printer (so-called line printer) which has a head 42 fixed at a given position without moving and ejects ink so as to form dots for a paper width at a single time is also acceptable.

Also, in the above-described embodiments, as one example of the fluid ejecting apparatus, the printer 1 which ejects ink has been exemplified and explained as an example. However, the invention is not to be limited to this. The invention can also be embodied in a fluid ejecting apparatus which ejects or discharges liquid other than ink (besides liquid, liquid body with particles of functional materials dispersed therein, liquid body such as gel, or the like), or fluid other than liquid (solid which can be ejected by flowing as fluid). For example, a fluid ejecting apparatus which ejects liquid including, in a dispersed or dissolved form, a material such as an electrode material or a color material, that are used in the manufacturing, etc. used in the manufacturing of a liquid crystal display, an EL (Electro Luminescence) display, or a plane emission display; a fluid ejecting apparatus which ejects a living organic material that is used in the manufacturing of a biochip; and a fluid ejecting apparatus which is used as a precision pipette and ejects liquid constituting a sample are also acceptable. In addition, a fluid ejecting apparatus which ejects lubricant oil as a pinpoint to a precision instrument such as a clock or a camera; a fluid ejecting apparatus which ejects transparent resin liquid such as ultraviolet cure resin on a substrate in order to form a micro hemispherical lens (optical lens) or the like that is used in an optical communication element or the like; a fluid ejecting apparatus which ejects etching liquid such as acid or alkali in order to etch a substrate or the like; a fluid ejecting apparatus which ejects gel; and a fluid ejecting apparatus which ejects a solid, for example, powder such as toner are also acceptable. Thus, the invention can be applied to any one kind of these fluid ejecting apparatuses.

What is claimed is:

1. A fluid ejecting apparatus comprising:

a rotating drum body which rotates while holding a medium wrapped around its circumferential surface;

a fluid ejecting section which ejects fluid toward the medium such that a margin is not formed at an end portion of the medium on the circumferential surface in an axial direction of the rotating body;

an absorber which absorbs fluid which has come out of the end portion of the medium on the circumferential surface in the axial direction, out of fluid ejected from the fluid ejecting section, at a position further outside than the end portion; and a rotating body driving mechanism for rotating the rotating body, which drives the rotating body such that driving force by the rotating body driving mechanism is not transmitted to the absorber, wherein the absorber is rotatable independently of the rotating body in a state where an axial direction of the absorber is coincident with the axial direction of the rotating body, and the apparatus further comprises an absorber driving mechanism for rotating the absorber.

2. The fluid ejecting apparatus according to claim 1, further comprising:

a recovery mechanism which recovers fluid absorbed by the absorber from the absorber.

3. The fluid ejecting apparatus according to claim 2, wherein the absorber has an outer circumferential portion made of a sponge and absorbs fluid which has come out of the end portion at the outer circumferential portion, and the recovery mechanism is provided with a pressing portion which presses the outer circumferential portion, and squeezes and recovers fluid absorbed by the absorber from the outer circumferential portion by allowing the pressing portion to press the outer circumferential portion when the absorber driving mechanism rotates the absorber.

4. The fluid ejecting apparatus according to claim 1, wherein a plurality of absorbers is provided, one on each side of the rotating body in the axial direction, a cover member which has an outer surface adjoining the circumferential surface of the rotating body in the axial direction and surrounds and covers the absorber is provided for each absorber, each of the cover members has an opening at the outer surface, the length of the circumferential surface in the axial direction is shorter than the length of the medium in the axial direction, the rotating body holds a central portion of the medium in the axial direction at the circumferential surface, the cover member holds an end portion of the medium in the axial direction at the outer surface, the fluid ejecting section faces the opening when ejecting fluid toward the end portion, and the absorber absorbs fluid which has come out of the end portion, at an exposed portion exposed by the opening, out of the absorber.

5. The fluid ejecting apparatus according to claim 1, wherein the rotating body is of a hollow shape and has in its circumferential surface a pair of openings located along the rotation direction of the rotting body, the absorber is disposed in the interior of the rotating body, the length of the circumferential surface in the axial direction is longer than the length of the medium in the axial direction, the rotating body holds the medium at the circumferential surface in a state where one end portion of the medium in the axial direction is located on one opening and the other end portion is located on the other opening, the fluid ejecting section faces the openings when ejecting fluid toward the one end portion and the other end portion, and the absorber absorbs fluid which has come out of the one end portion and the other end portion, at exposed portions exposed by the openings, out of the absorber.

6. A fluid ejecting apparatus comprising:

a rotating drum body which rotates while holding a medium wrapped around its circumferential surface;

a fluid ejecting section which ejects fluid toward the medium such that a margin is not formed at an end portion of the medium on the circumferential surface in an axial direction of the rotating body;

an absorber which absorbs fluid which has come out of the end portion of the medium on the circumferential surface in the axial direction, out of fluid ejected from the fluid ejecting section, at a position further outside than the end portion; and a rotating body driving mechanism for rotating the rotating body, which drives the rotating body such that driving force by the rotating body driving mechanism is not transmitted to the absorber, wherein the absorbers are provided one on each of both sides of the rotating body in the axial direction, a cover member which has an outer surface adjoining the circumferential surface of the rotating body in the axial direction and surrounds and covers the absorber is provided for each absorber, each of the cover members has an opening at the outer surface, the length of the circumferential surface in the axial direction is shorter than the length of the medium in the axial direction, the rotating body holds a central portion of the medium in the axial direction at the circumferential surface, the cover member holds an end portion of the medium in the axial direction at the outer surface, the fluid ejecting section faces the opening when ejecting fluid toward the end portion, and the absorber absorbs fluid which has come out of the end portion, at an exposed portion exposed by the opening, out of the absorber.

7. A fluid ejecting method comprising:

holding a medium on a circumferential surface of a rotating drum body which rotates so as to wrap the medium around its circumferential surface;

ejecting fluid toward the medium such that a margin is not formed at an end portion of the medium on the circumferential surface in an axial direction of the rotating body;

allowing fluid which has come out of the end portion of the medium on the circumferential surface in the axial direction, out of the ejected fluid, to be absorbed into an absorber at a portion further outside than the end portion;

driving the rotating body by a rotating body driving mechanism such that driving force by the rotating body driving mechanism is not transmitted to the absorber, and rotating the absorber independently of the rotating body in a state where an axial direction of the absorber is coincident with the axial direction of the rotating body, wherein the absorber is rotated by an absorber driving mechanism.

* * * * *